United States Patent [19]

Herold et al.

[11] 4,240,187

[45] Dec. 23, 1980

[54] METHOD AND APPARATUS FOR PLACING THREAD IN A TEXTURING APPARATUS AT SUPERSONIC SPEEDS

[75] Inventors: Heiko Herold, Neuss; Richard Herold; Rudolf Klee, both of Dormagen; Edgar Muschelknautz, Leverkusen, all of Fed. Rep. of Germany

[73] Assignee: Bayer Aktiengesellschaft, Leverkusen, Fed. Rep. of Germany

[21] Appl. No.: 956,115

[22] Filed: Oct. 30, 1978

[30] Foreign Application Priority Data

Nov. 3, 1977 [DE] Fed. Rep. of Germany ..... 2749188

[51] Int. Cl.[3] ..... D02G 1/12; D02G 1/16

[52] U.S. Cl. ..... 28/255; 28/272

[58] Field of Search ..... 28/255, 272

[56] References Cited

U.S. PATENT DOCUMENTS

| | | | |
|---|---|---|---|
| 3,424,359 | 1/1969 | Houle et al. | 28/255 X |
| 3,810,285 | 5/1974 | Ferrier et al. | 28/255 X |
| 3,970,231 | 7/1976 | Strutz et al. | 28/255 X |
| 4,014,085 | 3/1977 | Fink et al. | 28/255 X |
| 4,051,581 | 10/1977 | Biot et al. | 28/255 X |

FOREIGN PATENT DOCUMENTS

| | | | |
|---|---|---|---|
| 2652982 | 5/1978 | Fed. Rep. of Germany | 28/255 |
| 1437521 | 5/1976 | United Kingdom | 28/255 |

*Primary Examiner*—Robert Mackey

*Attorney, Agent, or Firm*—Sprung, Felfe, Horn, Lynch & Kramer

[57] ABSTRACT

An airstream impinging laterally on a thread can convey a running thread through an opening. This "placing" of threads in nozzles fails at elevated thread speeds. According to the invention, placing succeeds even at high thread speeds if a strong stream of propelling gas is divided in the nozzle into edge streams which are deflected outwards and a fine central stream which conveys the thread through the narrow opening.

5 Claims, 3 Drawing Figures

METHOD AND APPARATUS FOR PLACING THREAD IN A TEXTURING APPARATUS AT SUPERSONIC SPEEDS

The invention relates to a method of automatically inserting one or more rapidly running threads through a narrow opening in which the thread is initially guided transversely past the front of the opening, is severed downstream of the opening in the direction of travel of the thread and is conveyed through the opening by a propelling stream acting perpendicularly to the former direction of travel of the thread, and an apparatus for carrying out the method.

During the production of synthetic threads, the spun threads have to pass through treatment apparatus which have a narrow inlet opening, for example, a texturing nozzle or a false twist nozzle. The insertion of a thread through the mentioned openings is referred to hereinafter as "placing" of the thread and the narrow opening as "nozzle" or "texturing nozzle". Apparatus such as drawing-in needles or loops are known with which a thread can be placed. It is also known to "shoot" the severed thread running in front of the opening through the opening by means of a gas stream. With the known apparatus and methods, however, this can only be carried out if the speed of the thread is not too high. At higher thread speeds, the impulse transmitted to the thread by the gas stream is not sufficient to deflect the thread and the thread becomes entangled in the delivery mechanism. If the gas stream is replaced by a stream of liquid, the nozzle becomes moist inside and has firstly to be dried by the treatment medium. The nozzle is thus cooled and several minutes lapse before the desired temperature is attained again, in which time waste material is produced.

The object of the invention is to insert threads running at high speed into a narrow opening without wetting the thread and apparatus with liquid. The method should also be applicable if the thread speed exceeds 50 $ms^{-1}$.

According to the present invention, there is provided a method of automatically inserting one or more rapidly running threads through a narrow opening in which the thread is initially guided transversely past the front of the opening, is severed downstream of the opening in the direction of travel of the thread and is conveyed through the opening by a propelling gas stream acting perpendicularly to the former direction of travel of the thread, wherein a propelling gas stream, whose cross-section is larger than that of the narrow opening, is blown on to the thread and this stream is split up in front of the narrow opening by an arrangement connected upstream into a central stream which passes through the narrow opening and a plurality of streams which are led off upstream of the narrow opening.

The invention further provides an apparatus for automatically inserting one or more rapidly running threads through a narrow opening comprising guiding means for guiding the thread past the front of the opening, severing means downstream of the opening in the direction of travel of the thread, propelling gas supply means arranged to provide a stream of gas perpendicular to the former direction of travel of the thread, which stream at the entrance to the narrow opening has a cross-section larger than that of the narrow opening and an arrangement connected upstream of the narrow opening for leading off a plurality of gas streams.

This invention allows even those threads having a delivery speed above about 65 $ms^{-1}$ to be automatically conveyed through narrow openings such as, for example, through texturing nozzles, and it is noteworthy that the thread reliably enters the nozzle and does not enter the lateral passages.

It is preferred that the same fluid is used for placing the thread into a treatment apparatus and is at the same temperature as the fluid used for the treatment of the yarn.

It is also preferred that the arrangement connected upstream of the narrow opening comprises a thread inlet duct which widens to form an annular space and outward-leading passages or ducts are provided in the side of the annular space.

The invention is further described with reference to the accompanying drawings.

An arrangement 2 is connected upstream of the opening 1 in the texturing nozzle. This arrangement 2 contains a thread inlet duct 3 which widens into an annular space 4. Passages 5 are provided on the lateral perimeter of the annular space 4 for leading off the gas.

Figure 1:
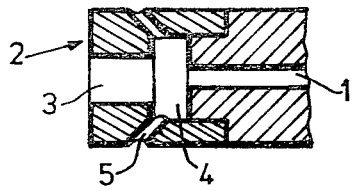
FIG. 1 shows a longitudinal section through a thread inlet duct.
Figure 2:
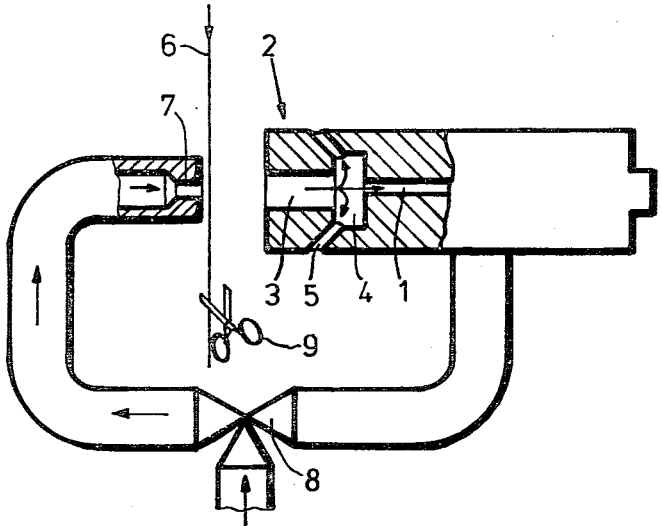
FIG. 2 shows the thread path and gas stream prior to placing in a texturing nozzle.
Figure 3:
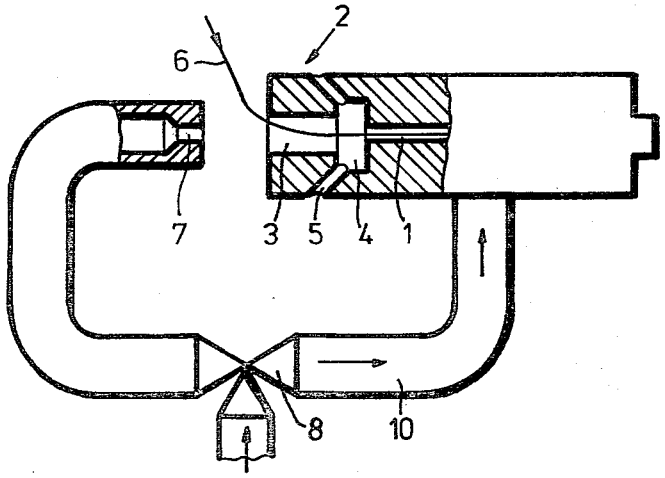
FIG. 3 shows the thread path and gas stream after placing into a texturing nozzle.

FIGS. 2 and 3 show diagrammatically the thread path and the gas stream. The thread 6 runs past the front of the thread inlet duct 3. The propelling nozzle 7 is charged via the valve 8 with propelling gas for the placing procedure and the thread 6 is severed by any cutting device 9 downstream of the thread inlet duct 3 in the direction of travel of the thread. The thread is conveyed into the thread inlet duct 3 by the propelling gas issuing from nozzle 7. The propelling stream is split up in the annular space 4 in such a way that a central stream conveys the thread 6 into the opening 1 in the texturing nozzle and that part of the propelling stream passes outwards through the lateral passages 5.

In the working position shown in FIG. 3, the (heated) propelling gas is used for the treatment of the thread. The yarn is conveyed further by the gas arriving via 10.

The thread of 150 dtex/34 f travels at a speed of approximately 58 $ms^{-1}$. It is to be placed onto a texturing nozzle whose nozzle inlet diameter amounted to $10^{-3}$ m. The diameter of the thread inlet duct amounts to $1.3\times10^{-3}$ m, the diameter of the annular space $2.6\times10^{-3}$ m with a depth of $2\times10^{-3}$ m. The partial removal of the edge streams of the propelling gas is performed by two passages each of $0.8\times10^{-3}$ m in diameter. The propelling nozzle has a diameter of $0.7\times10^{-3}$ m. Steam at a preliminary pressure of $9\times10^{5}$ $Nm^{-2}$ and at a temperature of 230° C. is used as propelling agent.

What we claim is:

1. In a method for inserting a longitudinally extended thread through a narrow opening in a texturing nozzle perpendicular to the axis of the thread, wherein the thread has been severed downstream of the opening and is untensioned, the improvement comprising: conveying the thread through a first passage upstream of the narrow opening and having a cross section which is larger than that of the narrow opening and an annular space having a cross section which is larger than that of the first passage and disposed downstream of the first passage and upstream of the narrow opening by providing a supersonic propelling gas stream acting externally of the first passage and on the thread perpendicularly to the thread axis, and splitting the stream up upstream of the narrow opening only in the annular space into a central stream which passes through the narrow opening and a plurality of streams which are led off upstream of the narrow opening whereby insertion of the thread into the first passage and annular space is effected solely by the supersonic propelling stream.

2. A method according to claim 1, further comprising utilizing the same gas for conveying and for thereafter treating the thread downstream of the narrow opening.

3. A method according to claim 2, wherein the gas used for the conveying is at the same temperature as that used for the treating of the thread.

4. In a texturing nozzle of the type having a longitudinally extending thread to be inserted through a narrow opening perpendicular to the axis of the thread and wherein the thread is severed downstream of the opening becoming untensioned and means for inserting the untensioned thread through the narrow opening, the improvement wherein the inserting means comprises: propelling gas supply means for providing a supersonic stream of gas perpendicular to the axis of the thread which stream at the entrance to the narrow opening has a cross-section larger than that of the narrow opening and means connected upstream of the narrow opening for splitting up the stream into a central stream which passes through the narrow opening and a plurality of gas streams which are let off upstream of the narrow opening wherein the stream splitting means comprises a thread inlet duct upstream of the narrow opening and having a larger cross-section than the narrow opening, an annular space connected thereto upstream of the narrow opening and downstream of the inlet duct and having a larger cross section, and a plurality of outward-leading passages only in the side of the annular space, the propelling gas supply means being external of the thread inlet duct and wherein thread insertion through the inlet duct and annular space is effected solely by the supersonic propelling stream therefrom.

5. An apparatus according to claim 4, wherein the propelling gas supply means comprises valve means for directing the propellant gas upstream of the entrance of the narrow opening for insertion and downstream thereof for the treatment of the thread.

* * * * *